US005503483A

United States Patent [19]

Petteruti et al.

[11] Patent Number: 5,503,483

[45] Date of Patent: Apr. 2, 1996

[54] PORTABLE SIGN PRINTER

[75] Inventors: Alfred J. Petteruti; Steven F. Petteruti; Robert A. Petteruti, all of East Greenwich; Majid Amani, Coventry; Ralph Almonte, Cranston, all of R.I.

[73] Assignee: Comtec Information Systems, Inc., Warwick, R.I.

[21] Appl. No.: 325,798

[22] Filed: Oct. 19, 1994

[51] Int. Cl.[6] ..... B41J 3/36

[52] U.S. Cl. ..... 400/88; 346/145; 346/136; 400/621

[58] Field of Search ..... 400/88, 120.01, 400/120.02, 120.16, 621, 613, 613.1; 346/145, 136

[56] References Cited

U.S. PATENT DOCUMENTS

| | | | |
|---|---|---|---|
| 4,833,547 | 5/1989 | Mase | 346/145 |
| 4,896,776 | 1/1990 | Kabanuk et al. | 346/145 |
| 4,926,191 | 5/1990 | Takenaka et al. | 400/621 X |
| 5,163,766 | 11/1992 | Fushimi et al. | 400/88 X |
| 5,267,800 | 12/1993 | Petteruti et al. | 400/88 |

*Primary Examiner*—Christopher A. Bennett
*Attorney, Agent, or Firm*—Testa, Hurwitz & Thibeault

[57] ABSTRACT

A portable printer is responsive to a terminal which provides to the printer control commands and data representative of information to be printed. The portable printer includes a spindle for receiving and holding a roll of stock and a direct thermal print mechanism which receives and prints information on the stock. The direct thermal print mechanism can receive and print, at various activation temperatures, on stock having a thickness up to about 0.015 inches or more and a width up to about 8.5 inches. The portable printer also includes a removable cutting mechanism for cutting the stock after the direct thermal print mechanism has printed information thereon. A programmable electronic controller included in the portable printer is responsive to the commands and data provided by the terminal for operating the direct thermal print mechanism. The electronic controller includes a microprocessor and memory, and it can detect and convey to the terminal an operating state of the printer. The portable printer also includes a rechargeable and removable battery pack for providing power to the direct thermal print mechanism and the electronic controller thereby allowing the printer to be transported and operated without a connection to a fixed-position external power source.

15 Claims, 11 Drawing Sheets

PORTABLE SIGN PRINTER

FIELD OF THE INVENTION

This invention relates to printers operated by digital data, and more particularly to a portable sign printer which is interactive with a terminal, the terminal supplying data representing information to be printed by the printer.

BACKGROUND OF THE INVENTION

A laser printer can be used to print signs and labels for use in retail establishments, warehouses, and factories. The size of a sign can be, for example, 8.5 inches by 11.0 inches, and the size of a label can be, for example, two inches by one inch. As used herein, a sign generally is bigger than a label. The signs and labels can include such information as the price and description of one or more items. The laser printer can receive the information to be printed from a computer connected thereto. The laser printer typically is not designed for portability; transporting the laser printer after it is set-up and ready to print can damage its printing mechanism. The laser printer typically is placed in a fixed location and printing of all signs and labels must be done at that fixed location. The signs and labels printed by the laser printer must then be carried manually to the places in the retail establishment, warehouse, or factory where they are to be displayed. If it is determined that the signs and labels are not accurate (e.g., wrong price or wrong description of goods), corrected signs and labels must be generated back at the laser printer and then the corrected signs and labels must again be carried manually to the display location.

The signs and labels printed by the laser printer can be printed on paper or "label-stock" which generally includes a series of printable surfaces adhesively and releasably attached to a web carrier backing. A feeder of the laser printer typically can be adjusted to receive and print on paper or label-stock of various widths such as paper or label-stock having a width of two to 8.5 inches. The length of the paper or the individual printable surfaces of the label-stock can vary as well. The overall size of the signs an labels output by the laser printer is dependent upon the particular paper or label-stock selected. The laser printer typically can only print on paper or label-stock having a thickness of 0.004 inches or less (i.e., 4 mils or less).

Laser printers require toner cartridges, and they also require periodic cleaning and servicing. They typically print less than twenty pages (8.5 inches by 11.0 inches) per minute.

SUMMARY OF THE INVENTION

A portable sign printer according to the invention is more versatile and useful than a fixed-station laser printer. The portable sign printer has a removable and rechargeable battery pack for providing power thereto. The printer can be transported to a location where a sign or label is to be displayed, print the required sign or label on-site at that location, and then be transported to the next location. The portable sign printer can print onto a variety of informational items including signs, labels, tickets, price change stickers, or receipts.

A terminal can be connected to the portable sign printer to provide the printer with data representative of the information to be printed on the sign or label. The terminal can itself be a portable device and can include, for example, a keypad and an optical character reader or bar code scanner. In a retail establishment, a code scanned by the terminal might indicate to the terminal that the item at that location should be marked down, in which case the terminal would generate and send to the portable sign printer the appropriate data sequence causing the printer to produce a sign or label with the discounted price as well as other information such as a description of the discounted item. The user would then place the newly printed sign or label on display for all shoppers to see. The terminal might have a wired or wireless connection to a central host computer, and the host could then download to the terminal the information to be printed for any particular item in the store as a user walks around. The user walks around from place to place until all locations at which signs or labels are to be printed and then displayed have been visited.

The terminal can be built into the portable sign printer. In these embodiments, signs can be made by keying or scanning a barcode that acts, when decoded by the terminal or the host computer, as an index into the sign information maintained by the host computer. The host computer then transmits the appropriate sign information to the terminal which in turn provides it to the printer which prints the corresponding sign.

The portable sign printer can print on paper or label-stock having a width up to about 8.5 inches (e.g., from two to 8.5 inches) and a thickness up to about fifteen mils (e.g., from two to fifteen mils) or more. The portable sign printer does not require a toner cartridge or messy ink ribbon, and it requires less cleaning and servicing than a typical laser printer. The portable sign printer uses direct thermal printing. It can print more than twenty pages (8.5 inches by 11.0 inches) per minute, and its print resolution is 305 dots per inch (dpi).

The portable sign printer can be mounted, transported, and operated on a rollable stand. In one embodiment, it weighs about 35 pounds, and is about 2 cubic feet in total size (e.g., about 2 feet wide by about 1.5 feet long by about 8 inches high). It can be provided in a suitcase for easy and safe portability and storage when not in use. With the top of the suitcase removed, the portable sign printer can be transported around (e.g., on the rollable stand) and used at various locations of the retail establishment, warehouse, or factory. In some embodiments, the printer and the terminal are housed in the same suitcase, and the terminal has the capability to communicate with the central host computer via a wireless RF link.

The portable sign printer is interactive with the terminal in that data is transferred from the terminal to the printer when the printer is ready to accept the data and not when the printer is busy or in some other state where it cannot handle the data (e.g., where the label-stock is not loaded or has run out or where the operating power is below limits). The portable sign printer can have a cutter mechanism for cutting the paper or label-stock at the appropriate length after the printing of a sign or label is complete. The printer also can have a peeler mechanism which enables the signs or labels to be peeled away from the carrier web after they are printed. The peeler does not interfere with the loading or threading of the web into the printer. The printer also can have an electronic controller which is intelligent and programmed to respond to the status of the printer as well as to commands for operating the print mechanism of the printer including controlling the print contrast, turning the print mechanism and itself on and off (for power-battery conservation), converting data from the terminal into the format or style (e.g., bar code, text, graphics, or lines) as dictated by the commands embedded in the data. The portable sign printer also can print at desired coordinates (x,y) on the sign or label by aligning the sign or label with respect to the printing elements of the print mechanism.

The foregoing and other objects, aspects, features, and advantages of the invention will become more apparent from the following description and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DESCRIPTION

Figure 1A:
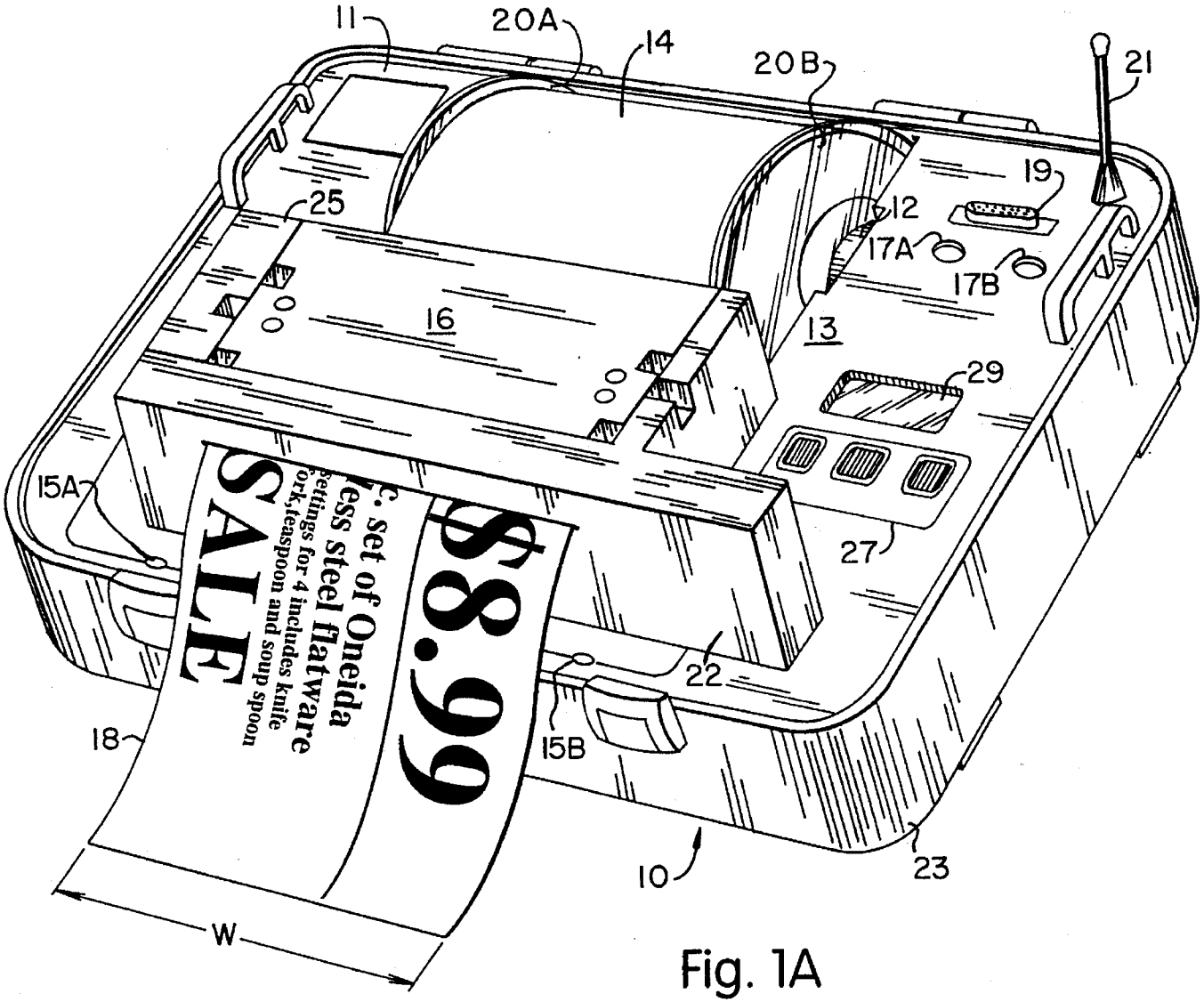
FIG. 1A is a perspective view of a portable sign printer according to the invention.
Figure 1B:
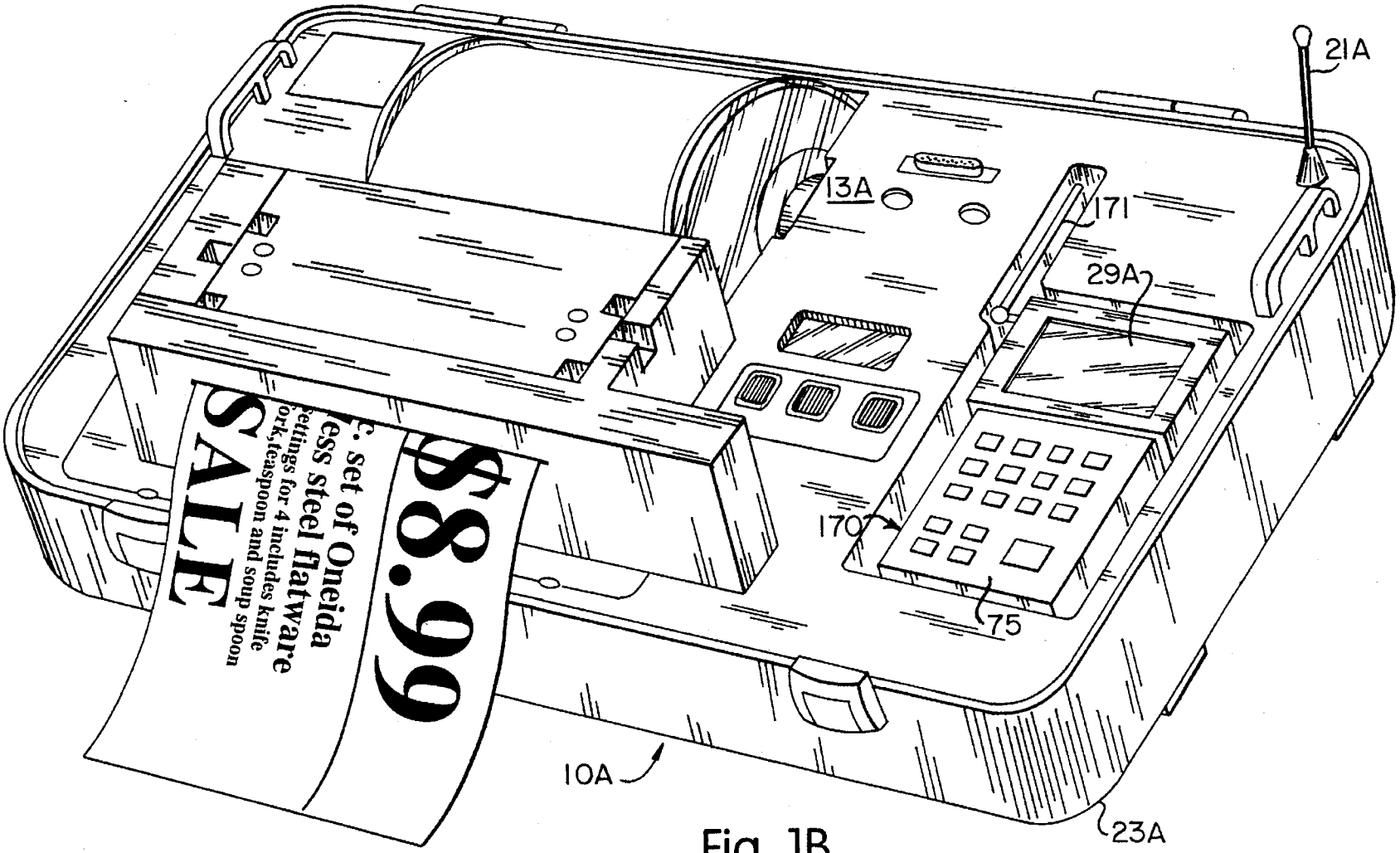
FIG. 1B is a perspective view of another embodiment of a portable sign printer according to the invention.
Figure 1C:
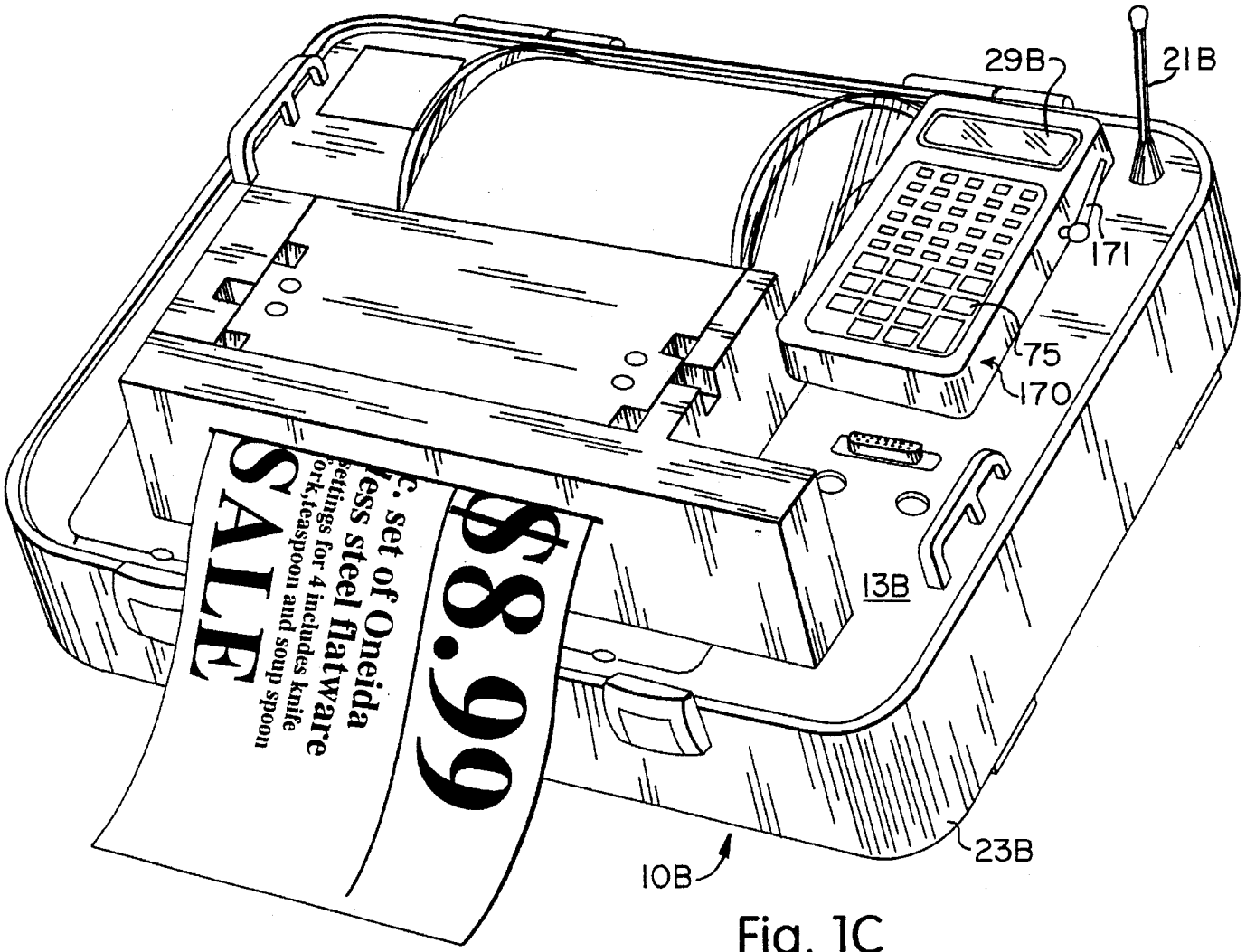
Figure 3:
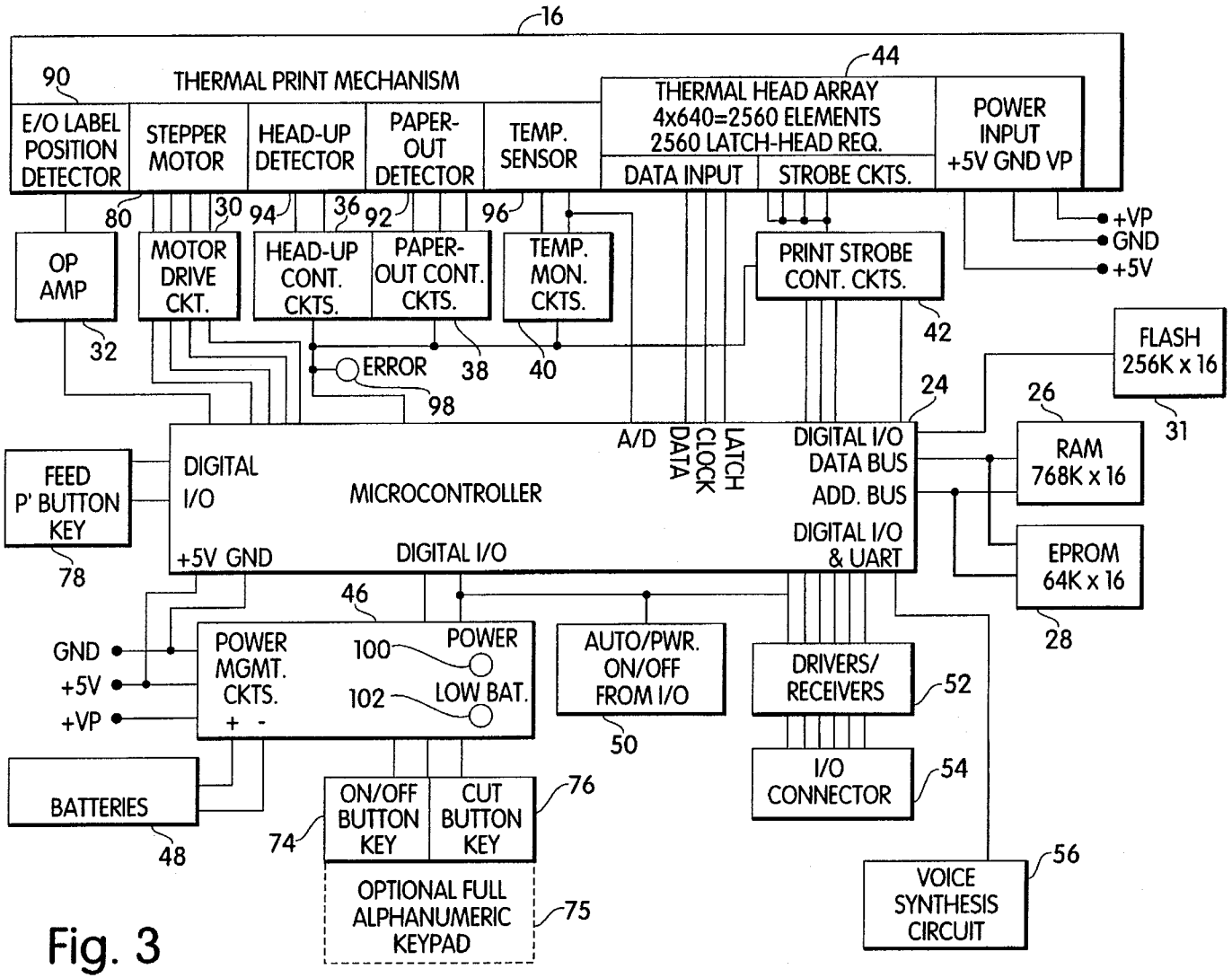
FIG. 3 is a block diagram of electronics of the printer of FIG. 1A and the connection thereof to other parts of the printer.

Referring to FIG. 1A, a portable sign printer 10 according to the invention is connectable and responsive to a terminal which provides to the printer 10 control commands and data representative of information to be printed. The connection between the terminal and the printer 10 can be wired or wireless. In some embodiments, the terminal is built into a face plate 13 of the printer 10, and the terminal can be removable therefrom. Each of FIGS. 1B and 1C depicts, respectively, a printer 10A, 10B having a terminal 170 removably disposed in a face plate 13A, 13B thereof. Both the printer 10A, 10B and the terminal 170 are housed in a suitcase 23A, 23B, the bottom portion of which is shown. The terminal 170 includes a keypad 75, a display 29A, 29B, and an RF antenna 171 to support wireless communication with the printer 10A, 10B through the RF antenna 21A, 21B. The terminal generally can be any type of reading device such as an optical character reader or bar code scanner. The terminal typically is a hand-held portable device with the reader/scanner and a full alphanumeric keypad 75 (FIGS. 1B, 1C and 3). U.S. Pat. No. 5,335,170 (issued on Aug. 2, 1994) and U.S. patent application Ser. No. 08/284,052 (filed on Aug. 1, 1994 as a continuation-in-part of U.S. Pat. No. 5,335,170) describe hand-holdable terminals which can be used with the printer 10. This patent and patent application are incorporated herein by reference.

The portable sign printer 10 includes a spindle 12 for receiving and holding a roll of stock 14. The stock 14 can be paper or label-stock, where label-stock generally includes a series of printable surfaces adhesively and releasably attached to a web carrier backing. The stock 14 also can be a series of printable surfaces where each printable surface has an adhesive coating on the back thereof, but there is no backing to which the adhesive is releasably attached. These backing-less labels/signs typically are referred to as linerless labels/signs. The printer 10 also includes a direct thermal print mechanism 16 which receives and prints information on the stock 14 to create a sign or label 18. A release latch 25 allows a printhead of the print mechanism 16 to be manually engaged and disengaged. The print mechanism 16 prints with a resolution of 305 dots per inch (dpi), and it can print at least about 20 pages per minute where the size of a page is about 8.5 inches by about 11.0 inches. The direct thermal print mechanism 16 can receive and print on stock 14 having a width, W, up to about 8.5 inches and a thickness up to about 0.015 inches (i.e., fifteen mils) or more. The width, W, can range from about 2.0 to 8.5 inches, and the thickness can range from about 2 to 15 mils or more. The spindle 12 has adjustable edges guides 20A, 20B for holding and feeding the stock 14 to the print mechanism 16 in proper alignment.

The direct thermal print mechanism 16 can be controlled (by a programmable electronic controller assembly in the printer 10 which is responsive to the commands and data provided by the terminal) to create black printing on thermal stock by activating the printhead of the mechanism 16 at a predetermined temperature. The mechanism 16 also can be controlled to create color printing on coated thermal stock by activating the printhead of the mechanism 16 at a plurality of temperatures, where each of the temperatures corresponds to a different color. The activation temperatures for individual colors typically are separated by about 20 degrees Fahrenheit. In the disclosed embodiment, the three colors that can be activated are cyan, magenta, and blue. The direct thermal print mechanism 16 does not need color print ribbons to print in color.

Figure 2A:
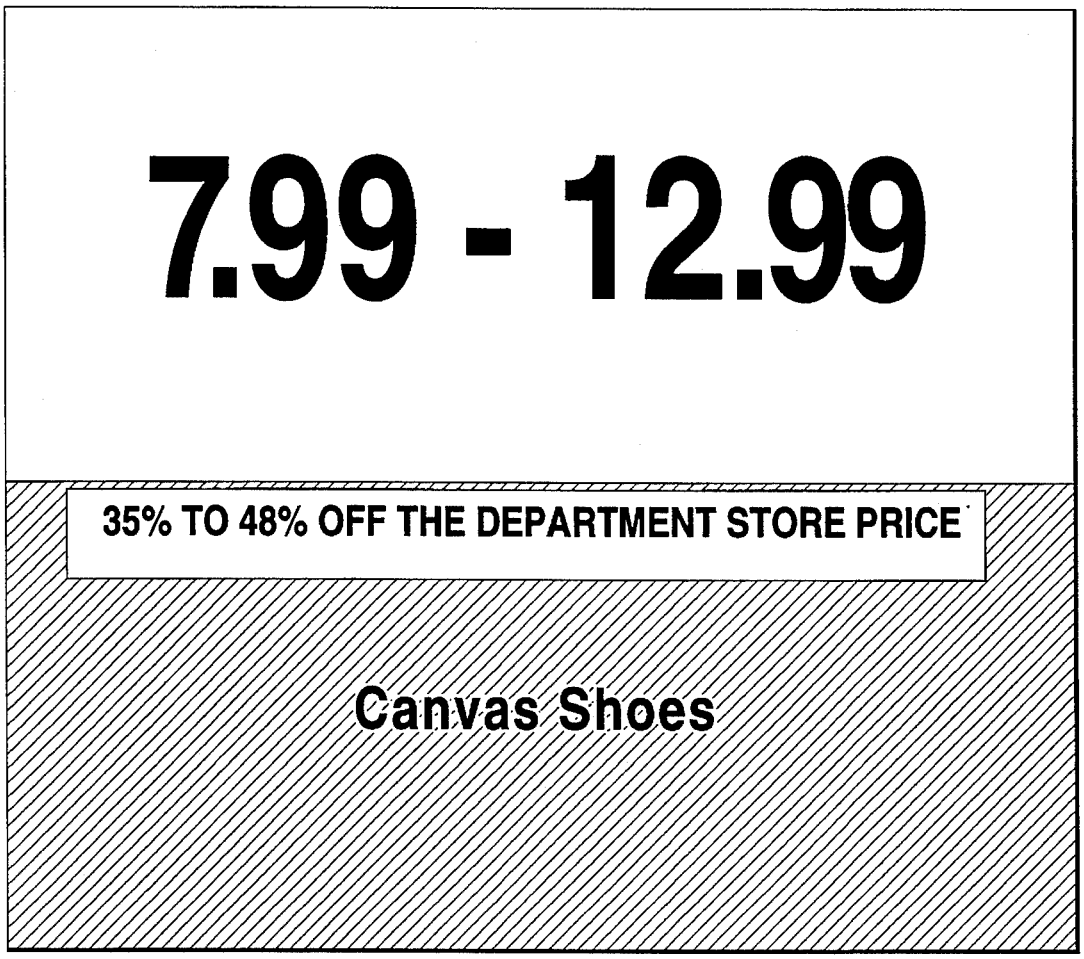
FIGS. 2A, 2B, and 2C are examples of signs and labels which the printer of FIG. 1A can produce.
Figure 2B:
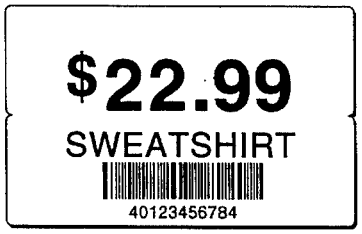
Figure 2C:
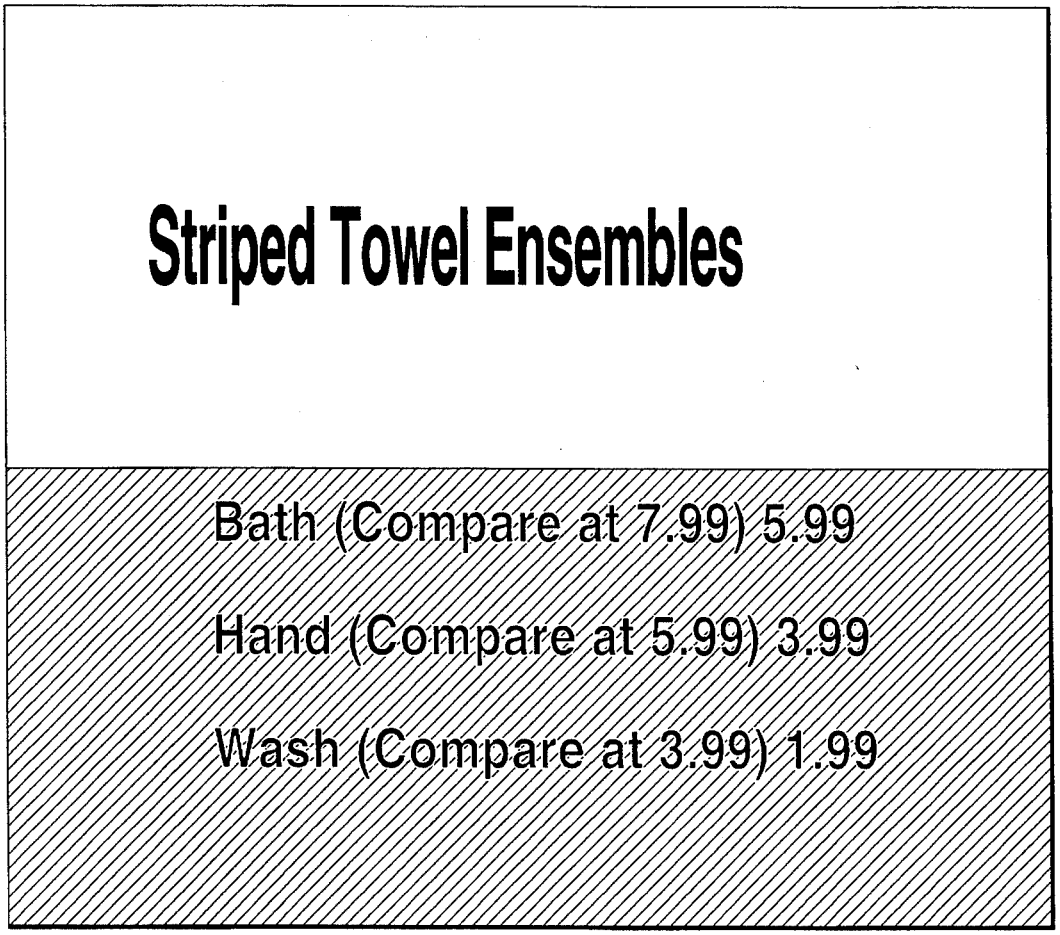

For the purposes of this disclosure, a "sign" generally refers to a printed item which is larger than a "label". A sign can be, for example, about 8.5 inches by 11.0 inches, and a label can be, for example, about 1.25 inches by 2.0 inches. As used herein, the terms sign and label are meant to cover a variety of printed items including signs, labels, tickets, price change stickers, and receipts. The printer 10 is capable of producing printed items having a variety of sizes, the size of the printed item being dependent on the size of the stock 14 fed into the print mechanism 16. Examples of signs produced by the printer 10 are shown in FIGS. 2A and 2C, and an example of a label produced by the printer 10 is shown in FIG. 2B.

Referring back to FIG. 1A, the portable printer 10 further includes a cutting mechanism 22 for cutting the stock 14 after the direct thermal print mechanism 16 has printed information thereon. The cutting mechanism 22 preferably is removable from its location at the output side of the print mechanism 16. The programmable electronic controller assembly in the printer 10 is responsive to the commands and data provided by the terminal for operating the direct thermal print mechanism 16. The programmable electronic controller assembly, which includes a microprocessor and memory, is described in more detail later with reference to FIG. 3. The assembly can detect and convey to the terminal an operating state of the printer 10.

A rechargeable and removable battery pack 48 (see FIG. 3) of the printer 10 provides power thereto, specifically to the direct thermal print mechanism 16 and the programmable electronic controller assembly. The battery pack 48 is located under the cutting mechanism 22, and it is accessed and removed by removing screws 15A, 15B. The battery pack 48 can include one or more NiCd batteries, one or more lead acid batteries, one or more NiMH batteries, or one or more lithium ion batteries. Other types of batteries also can be used. The battery pack 48 can provide power to the printer 10 as the battery pack 48 is being recharged. A charger jack 11 is provided for connecting a charging source to the battery pack 48.

The battery pack 48 allows the printer 10 to be transported and operated without a connection to a fixed-position external power source. For example, in a retail establishment, a code scanned by the terminal might indicate to the terminal that the item at that location should be marked down, in which case the terminal would generate and send to the portable sign printer 10 the appropriate data sequence causing the printer 10 to produce a sign or label 18 with the discounted price as well as other information such as a description of the discounted item (see FIGS. 2A, 2B, and 2C). The user would then place the newly printed sign or label 18 on display for all shoppers to see. The terminal might have a wired or wireless connection to a central host computer, and the host could then download to the terminal the information to be printed for any particular item in the store as a user walks around the store with the terminal and the portable sign printer 10.

The printer 10 has three (two are shown) serial communication ports 17A, 17B and one parallel communication port 19. An optional RF antenna 21 can be provided for receiving an RF signal which would allow, for example, the printer 10 to receive data and control commands from a terminal or host computer which is not hard-wired to one of the communication ports 17A, 17B, 19. Typically, the terminal, scanner, or host computer will be directly coupled to one of the communication ports.

The portable sign printer 10 preferably is housed in a suitcase. Only a bottom 23 of the suitcase is shown in FIG. 1. The printer 10 is shown in FIG. 1 with a top of the suitcase removed to allow the printer 10 to be operated. With the printer 10 as shown in FIG. 1A, it can be placed on a rollable cart or stand for easy portability and operation at any location in a retail establishment, warehouse, or factory. When the top is replaced and closed, the printer 10 can be easily and safely transported and/or stored when not in use. In some embodiments, the terminal also is housed in the suitcase.

In one embodiment, the weight of the printer 10 including the suitcase is about 35 pounds, and it has a volume of about 2 cubic feet (e.g., about 2 feet wide by about 1.5 feet long by about 8 inches high).

The portable sign printer 10 has three keys 27. One key turns the printer 10 on and off, another key activates the cutting mechanism 22, and another key causes the print mechanism 16 to feed stock 14 therethrough. These three keys are identified by the reference numerals 74, 76, 78 in FIG. 3. As shown in FIG. 3, in some embodiments such as when the terminal is removably integrated with the printer 10 as described previously with reference to FIG. 1A, the printer 10 can be provided with the full alphanumeric keypad 75 (e.g., having 45 alphanumeric keys) instead of just the three keys 74, 76, 78. A display 29, preferably an LCD, also is provided for displaying operational information including the operating state of the printer and the status of the battery pack. The keys and the display are coupled to the programmable electronic controller assembly (FIG. 3).

The portable sign printer 10 can have a peeler mechanism disposed adjacent, or in place of, the cutting mechanism 22. When the stock 14 is label-stock, the peeler mechanism peels the printable surfaces away from the web carrier backing after information is printed thereon by the direct thermal print mechanism 16 and as the sign or label 18 is exiting the print mechanism 16 or cutting mechanism 22.

In some embodiments, the web carrier backing of the label-stock has lines printed thereacross and disposed in spaced relationship with the printable surfaces to indicate the location of the printable surfaces on the web carrier backing. In these embodiments, the direct thermal print mechanism 16 includes means for detecting the lines and the programmable electronic controller assembly is responsive to the detecting means for operating the direct thermal print mechanism 16 to feed the stock through the direct thermal print mechanism 16 to the next printable surface, as described hereinafter with reference to FIG. 3.

Referring to FIG. 3, the programmable electronic controller assembly includes a microprocessor or microcontroller 24, a random access memory (RAM) 26, a flash memory 31, and an erasable programmable read only memory (EPROM) 28. In one embodiment, the microcontroller 24 is a 32-bit microprocessor which runs at either 20, 25, or 33 MHz, and the printer 10 has a total of over 2 megabytes of memory. The RAM and the EPROM are connected to the microcontroller 24 by a 16-bit (i.e., 16-line) data bus and a 32-line address bus. A voice synthesis circuit 56 is provided which produces audible and intelligible statements, instructions, and/or questions to a user under the control of the microcontroller 24. The microcontroller 24 can cause the voice synthesis circuit 56 to generate an appropriate message in response to any condition or event controllable or detectable by the microcontroller 24 (e.g., a paper-out condition). There are sensor and control circuits, namely: a motor driver circuit 30; an operational amplifier circuit 32 which buffers signals from an electro-optical (E/O) detector 90 of the direct thermal print mechanism 16; control and monitoring circuits 36, 38, and 40; and a control circuit 42 which operates printer elements in a thermal head array 44 of the direct thermal print mechanism 16. There is also a power management circuit 46 which controls the application of power from the battery pack 48, an automatic power on/off control circuit 50 which controls the powering up and down (on/off) of the printer including the microcontroller 24 and the direct thermal print mechanism 16, and interface circuits 52 in the form of drivers and receivers which operate in accordance with the IEEE RS232C protocol and are connected to an input/output (I/O) connector 54. The terminal or host computer can be connected to the I/O connector 54 to provide the printer 10 with the control commands and data representative of the information to be printed on the stock 14. The connection to the terminal or host computer may be by other hard-wired methods such as IEEE RS485 or parallel methods, or by wireless methods such as RF or light-wave (e.g., infrared). There are several signals which are applied to the microcontroller 24 by way of the I/O connector 54 from the terminal. These may be a signal on one connector pin or line over which data is received into the printer 10. This is called the TXD line. Another input from the terminal is a line indicating that the terminal is ready to send and is called the RTS line. There is a ground line and a line from the terminal providing a so-called "soft on/off" which enables the terminal to turn the printer 10 on when the terminal is turned on and turn the printer 10 off when the terminal is turned off, as when battery conservation is desired. This line is called the DTR line. The printer 10 is interactive with the terminal and transmits data to the terminal over a line which is connected to a pin of the I/O connector 54 called the RXD line. It also provides a signal indicating that the printer 10 is clear to receive commands and data. This is called the CTS line. There is also a line which is used to acknowledge to the terminal that the printer 10 is on when it is set high. This is called the DSR or data set ready line. The interactive information to the terminal may be an 8-bit data signal or status byte, individual bits of which have the following meaning: printer 10 busy; stock 14 out; head array 44 up or down (position of release latch 25); battery pack 48 voltage high or low; reset (i.e., the printer 10 has been powered down or shut off); motor direction (a motor 80 is a two-phase stepper motor which can be driven to feed-out or take-in the stock 14 depending upon the sequence of pulses which are applied to the phases via the motor drive circuit 30); and two print contrast bits. The thermal head array 44 is capable of different degrees of darkness or print contrast by switching on strobe pulses which control gates which apply current via the print strobe circuits 42 from the digital I/O (pulse width modulated) outputs of the microcontroller 24. There are 2 bits indicative of 4 levels of print contrast. The normal print contrast level may be when the 2 bits are equal to 0 and the controller is designed to default to that print contrast state.

In some embodiments, the printer 10 can provide different "effect" modes of printing. The normal mode is an "OR" mode in which either new data or old data is applied to the printhead. Another mode is the "XOR" mode (an exclusive OR mode) which enables use of existing data for printing or new data for printing, whichever is present to be used. This allows old or new data to be used for different elements of the label in different blocks or coordinates thereon where printing may be carried out. The other effect mode is the "AND" mode wherein the new data will write over the old data even though the old data is present. The print mechanism 16 has gate circuits for providing strobing, a latch register in which the data for a line of 384 dots is stored, and a shift register in which the data for a line is entered and then transferred to the latch register and to provide current for the printing elements of the head array 44 via the gates when they are strobed on. The microcontroller 24 provides data one line at a time to the shift register over the data line to the data input of the array head 44. The register receives clock pulses over the clock line and the data from the shift register is transferred to the latch register when a latch pulse is received over the latch line. The speed of the motor 80 is controlled in response to signals from the temperature sensor 96 so that the line feed is synchronized with the data input to the array head 44. The motor 80 may be driven in the take-up direction when striking over or double printing on the same sign/label or the same line of the sign/label is desired. In the print mechanism 16, because of the capacity of the RAM 26 in which the data representing the material to be printed is stored, the maximum number of lines is 3360.

The RXD line may also provide data to the terminal concerning print contrast, the battery level, the serial number of the printer 10 and an odometer reading as to how much stock 14 has passed through the direct thermal print mechanism 16. This reading may be obtained by retaining a count of the number of lines or bars which are detected by the E/O label position detector 90. This count is translated into meters of stock 14 and can be read out from the printer to the terminal, printed on a sign or label, or displayed on the display 29.

The microcontroller 24 also provides self-test capability. This self-test capability can be accessed using a predetermined sequence and/or combination of the keys 74, 76, 78, 75. Once in the self-test mode, the print mechanism 16 prints bars which will show if there are any gaps in the print area. The printer 10 can also be programmed to print out other patterns when put into the self-test mode such as checkerboard patterns. In one embodiment, the printed output that results from triggering the self-test mode also has the revision number of the computer program stored in the EPROM 28, the battery voltage, printer 10 serial number, low battery trip point, and list of available fonts.

The direct thermal print mechanism 16 has the motor 80, the electro-optical (E/O) assembly 90, and an electro-optical paper-out detector 92 which receives light from a light emitting diode (LED) in the paper out detector 92 when the paper path is clear and not blocked by the stock 14. There is also a head-up detector 94 which is a switch operated by the release latch 25. There is also a temperature sensor 96 (a thermistor) in the print mechanism 16 which detects the temperature of the thermal head array 44 and provides an output to the microcontroller 24 via an analog to digital (A/D) converter. The temperature monitoring circuits 40, the head-up control circuits 36, and the paper-out control circuits 38, when the temperature is too high, the paper is out, or the head array 44 is released, operate through the microcontroller 24 to cause illumination of an error LED 98. There are other LEDs 100, 102 associated with the power management circuits 46 which illuminate when the battery 48 is low and when the printer is on. In preferred embodiments, the LEDs 98, 100, 102 are replaced with appropriate messages displayed on the display 29 (FIG. 1A).

The stock 14 may be loaded automatically or manually. For automatic loading, the array head 44 of the print mechanism 16 is released using the release latch 25. When the array head 44 is closed by manual operation of the release latch 25, the motor 80 is automatically turned on and it feeds until the electro-optical detector 90 sees a lack of reflected light which indicates the location of a line or bar printed on the web carrier backing (as mentioned previously). The motor 80 then stops. The loading may also be accomplished by leaving the array head 44 in the engaged position in which case insertion of the stock 14 in the print mechanism 16 starts the motor 80. The motor 80 then runs until it sees a line or bar. The controller has a maximum run length control to allow, for example, the motor 80 to run so that the stock is advanced a predetermined distance (e.g., about 10 centimeters). This timeout operation is a safety backup against excessive feeding of the stock 14 during loading.

Figure 4:
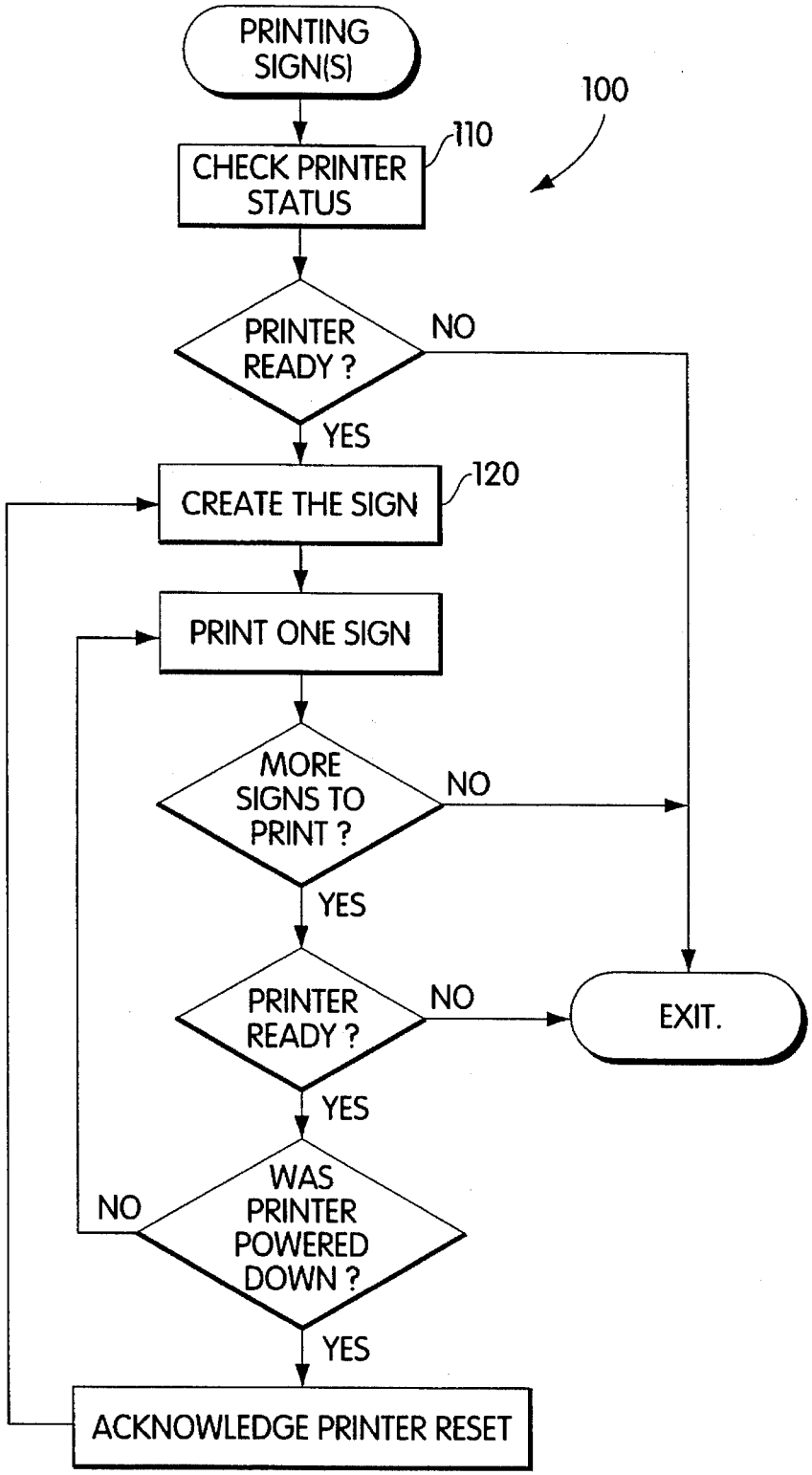
FIG. 4 is a flow chart of the computer system operation for printing signs and labels which is executed by the electronics of FIG. 3.

Referring to FIG. 4, the computer system operation 100 executed by the programmable electronic controller assembly of the printer 10 is shown in flow chart format. The flow chart of FIG. 4 shows the steps performed by the printer 10 for sign or label printing. The first step (step 110) is to execute the check printer status subroutine which is shown in FIG. 5.

Figure 5:
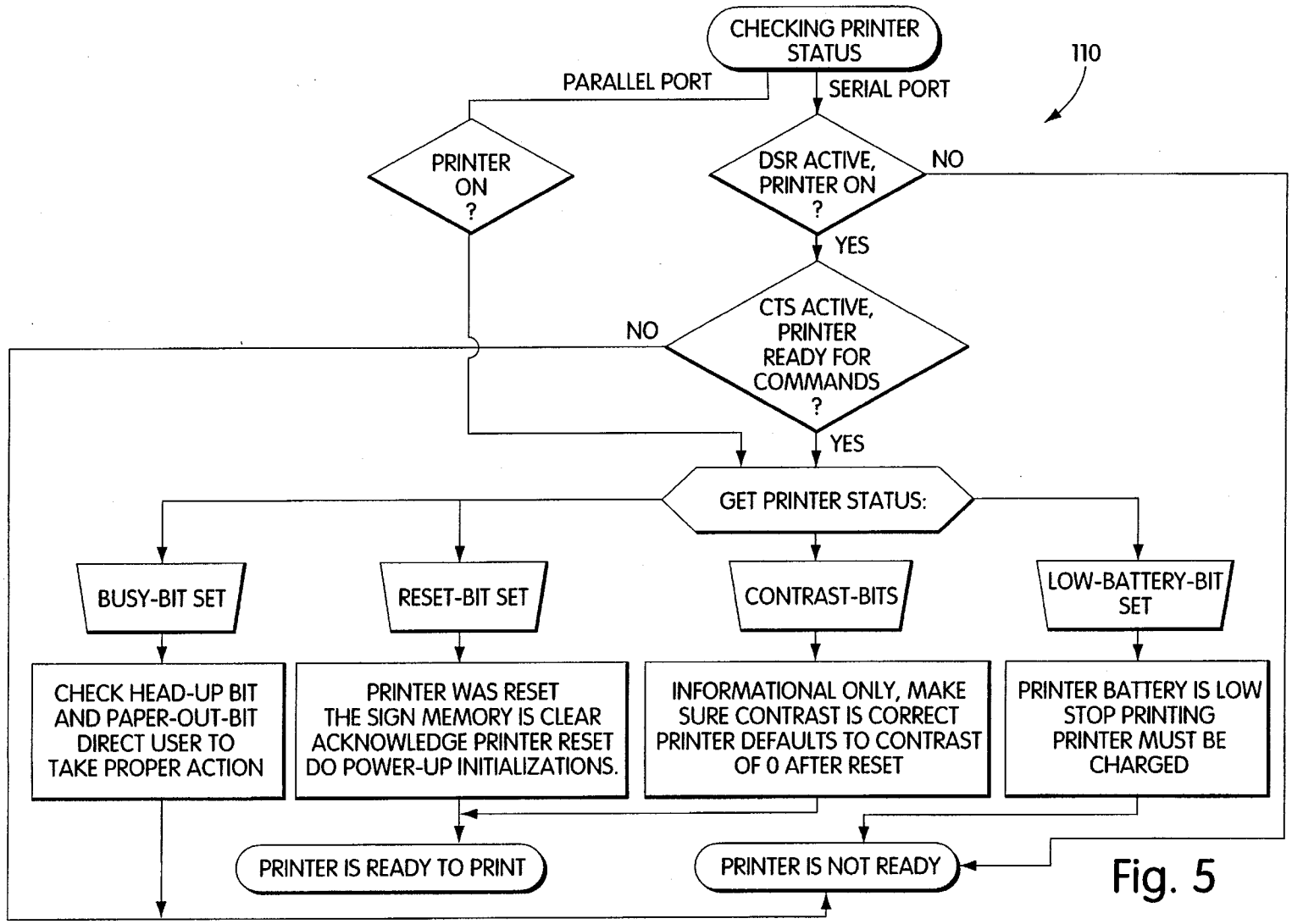
FIG. 5 is a flow chart of a subroutine executed by the electronics of FIG. 3 for checking the printer status.

Referring to FIG. 5, first there is the handshaking operation between the printer and the terminal using the DSR and CTS lines. If the printer is on and not busy the status byte is then read. Each bit is assembled into the status byte and transmitted to the terminal on the RXD line, indicating to the terminal the status of the printer.

Referring back to FIG. 4, when the printer 10 is ready, commands are received from the terminal via the RXD line to either set the effect mode, the print contrast, the feed direction, or to obtain certain reports which will then be sent via the TXD line back to the terminal. For example, the microcontroller 24 may report battery level, serial number, or odometer (ODM) reading via the TXD line so that it can be available to the terminal and printed out by the printer 10 or displayed on the display 29. After the reports and commands are handled, a command arrives to create a sign or label (step 120). The create a sign subroutine shown in FIG. 6 is then invoked.

Figure 6:
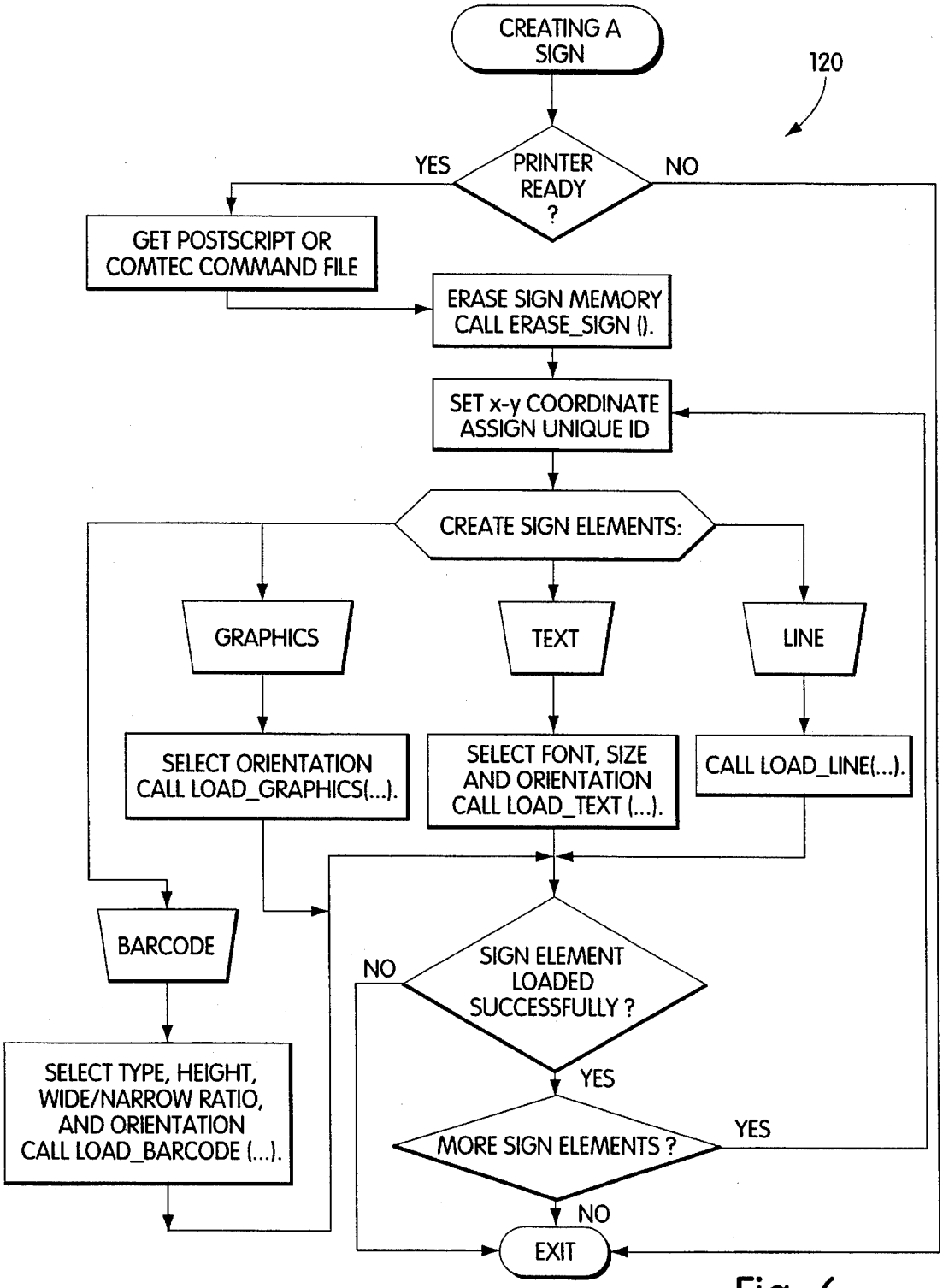
FIG. 6 is a flow chart of a subroutine executed by the electronics of FIG. 3 for creating a sign or label.

Referring to FIG. 6, the printer ready subroutine is checked and then the Postcript command file is retrieved from the terminal. Note that this command file allows the printer 10 to print in a variety of fonts. In fact, any fonts which a fixed-station laser printer can produce can also be produced by the printer 10 after the appropriate command file has been downloaded thereinto. Comtec Information Systems, Inc., the assignee, produces its own command file which can be used instead of a Postscript command file. After the Postscript or Comtec command file is downloaded to the printer 10 by the terminal, data indicating the number, N, of the sign/label is checked. If the same sign/label as last time is to be printed again, the program proceeds to process the sign/label element, type, and coordinate data from the terminal which is received via the TXD line for each sign/label element. If a new sign/label is to be printed (i.e., N=0), the portion of the memory 26 containing the previously-printed sign/label is erased and the process to enter the program which concerns sign/label elements of various type and to locate those elements in desired "coordinates on the sign/label is invoked.

The element types are bar codes, graphics (logos), text, or lines. Different data conversion programs are executed depending on element type. For bar codes, the program selects different kinds of codes and height and width for the bars and spaces. There bar code types and fonts for text are stored in the memory of the microcontroller 24 in the EPROM 28. The effect mode is selected in accordance with the command therefor. Then the data in format for printing is entered into the RAM 26 to provide a map of the sign/label in memory space.

Referring back again to FIG. 4, the sign or label is printed by reading out the data from the RAM 26 into the head array 44, one 64-bit segment of each line at a time. The 64-bit segments are printed on the stock 14 by the print mechanism 16 to create (print) the sign or label 18. If N=0, the process returns to print the same information on the next sign or label. If N is greater than zero, a new label is to be printed with fresh information and the check status routine is again invoked. However, before reprinting, the rest bit is checked because if it is high the printer 10 has been powered down. This is quite likely since it is desirable to turn the printer off, except when it is supposed to be printing a sign or label, for battery pack 48 conservation purposes. An acknowledge command is received from the terminal to assure that the terminal's program to output data and commands for the sign/label will be transmitted to the printer 10.

Figure 7A:
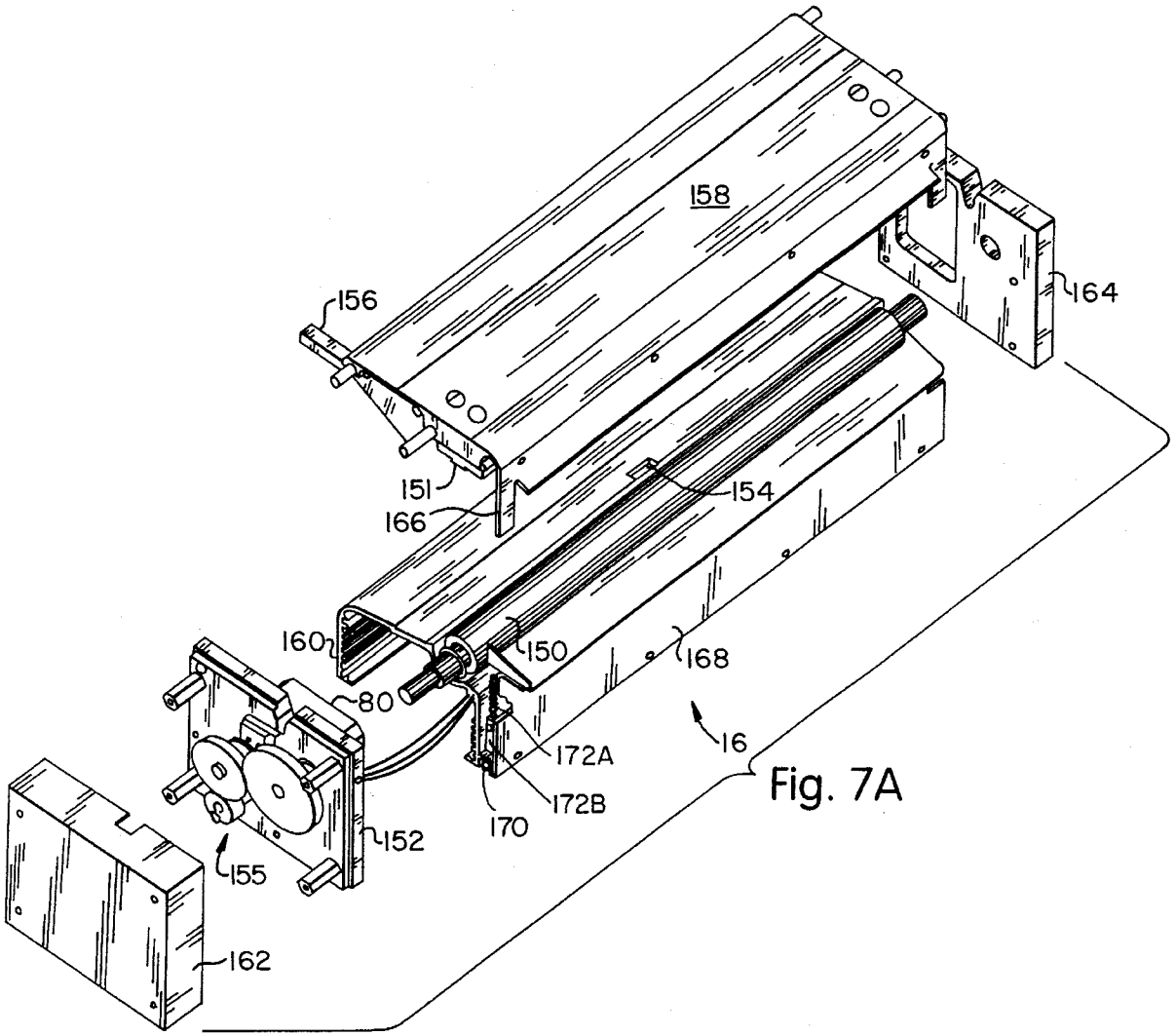
FIG. 7A is a perspective, exploded view of a direct thermal print mechanism of the printer of FIG. 1A.
Figure 7B:
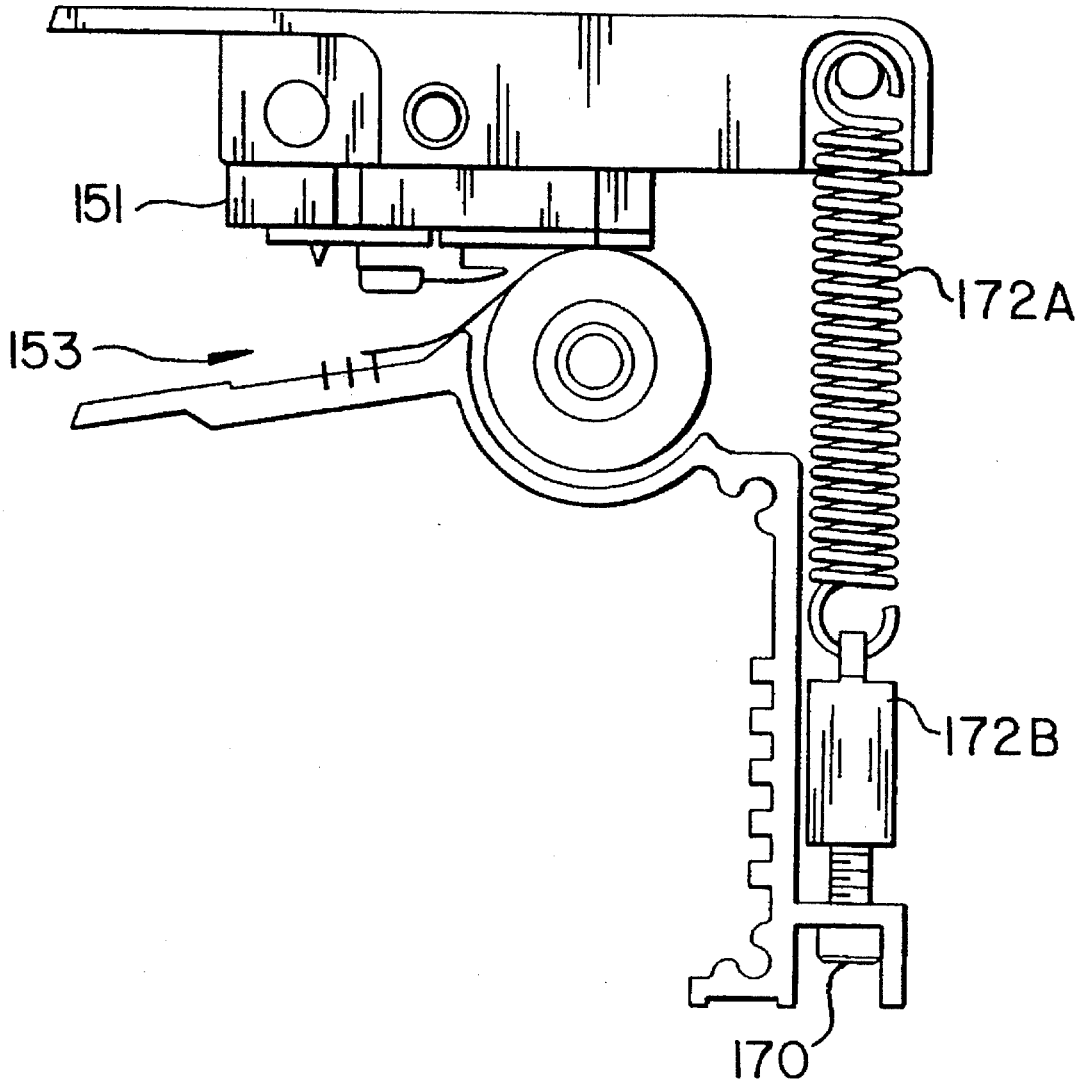
FIG. 7B is a end view of a portion of the print mechanism of FIG. 7B.

Referring to FIGS. 7A and 7B, the direct thermal print mechanism 16 includes a platen 150, a motor assembly 152 having the motor 80 for driving the platen 150 through a gear train (shown generally at 155), a paper feed funnel 153, a paper sensor window 154, and a cam lever 156 (same as release latch 25 of FIG. 1) for camming a top head assembly 158 (which includes the printhead 151) toward or away from the platen 150. The printhead 151 is disposed adjacent to the platen 150 and acts as a pressure pad to hold the stock against the platen 150 (when the top head assembly 80 is cammed toward the platen 150 by use of the lever 156) so that the stock may be driven by the platen 150 when the platen 150 is driven by the motor 152 via the gear train. Printhead pressure is adjustable by tightening or loosening screws 170 of an adjustable spring mechanism 172A, 172B. The printhead 151 includes a metal heat sink bar and an insulating bar in which a row of 2560 elements is contained. The mechanism 16 has a chassis which includes the top head assembly 158 and a bottom extrusion 160. A cover 162 goes over the motor assembly 152, and an endpiece 164 covers the other end of the mechanism 16. There are top front 166 and bottom front 168 paper guides.

In order to print successfully on the linerless labels/signs described previously with reference to FIG. 1A, the direct thermal print mechanism 16 should include certain special features. Specifically, the paper feed funnel 153 should be lined with teflon or other non-stick material and the platen 150 should be coated with or made of silicone or other non-stick material.

Variations, modifications, and other implementations of what is described herein will occur to those of ordinary skill in the art without departing from the spirit and the scope of the invention as claimed. Accordingly, the invention is to be defined not by the preceding illustrative description but instead by the following claims.

What is claimed is:

1. A portable printer responsive to a terminal which provides to the printer control commands and data representative of information to be printed, the portable printer comprising:

a spindle for receiving, holding, and dispensing a roll of stock, the spindle having at least one adjustable edge guide to align stock dispensed therefrom in a predetermined alignment with at least one downstream component;

a direct thermal print mechanism comprising a printhead, a stock feed platen, and an adjustable spring mechanism, the printhead being resiliently biased toward the stock feed platen by the adjustable spring mechanism which is operatively disposed to permit adjustment of pressure of the printhead on the platen, the direct thermal print mechanism being capable of receiving and printing on stock dispensed from the spindle;

a cutting mechanism disposed downstream of the direct thermal print mechanism for cutting stock exiting the direct thermal print mechanism;

a programmable electronic controller responsive to the commands and data provided by the terminal for operating the direct thermal print mechanism, the electronic controller including a microprocessor and memory and being capable of detecting and conveying to the terminal an operating state of the printer; and a rechargeable and removable battery pack for providing power to the direct thermal print mechanism and the electronic controller thereby allowing the printer to be transported and operated without a connection to a fixed-position external power source.

2. The portable printer of claim 1 wherein the printer is housed in a suitcase.

3. The portable printer of claim 2 wherein the terminal also is housed in the suitcase.

4. The portable printer of claim 1 wherein the printer weighs about 35 pounds and has a volume of about 2 cubic feet.

5. The portable printer of claim 1 wherein the direct thermal print mechanism prints at a rate Of at least about 20 pages per minute where size of a page is about 8.5 inches in width by about 11.0 inches.

6. The portable printer of claim 1 wherein the direct thermal print mechanism has a print resolution of about 305 dots per inch.

7. The portable printer of claim 1 wherein the direct thermal print mechanism further comprises a thermal head array and a sensor, temperature of the thermal head array of the direct thermal print mechanism being controlled by the programmable electronic controller as a function of at least one desired print contrast temperature and actual thermal head array temperature measured by the sensor.

8. The portable printer of claim 1 further comprising a key pad coupled to the electronic controller for providing signals to the electronic controller which cause the printer to turn on and off, the direct thermal print mechanism to feed stock therethrough, or the cutting mechanism to operate.

9. The portable printer of claim 8 further comprising a display coupled to the electronic controller for displaying operational information including the operating state of the printer and status of the battery pack.

10. The portable printer of claim 1 further comprising at least one communications port for coupling the terminal to the printer.

11. The portable printer of claim 1 wherein the direct thermal print mechanism is capable of receiving and printing on stock having a width of about 8.5 inches and a thickness of up to about 0.015 inches or more.

12. The portable printer of claim 11 wherein the direct thermal print mechanism is capable of receiving and printing on stock having a series of printable surfaces adhesively and releasably attached to a web carrier backing.

13. The portable printer of claim 11 wherein the direct thermal printer mechanism is capable of receiving and printing on stock having a series of printable surfaces having an adhesive coating on respective backs thereof.

14. The portable printer of claim 12 wherein the direct thermal print mechanism includes means for detecting lines disposed on stock web carrier backing passing therethrough and the electronic controller is responsive to the detecting means for operating the direct thermal print mechanism to feed web carrier backed stock through the direct thermal print mechanism to a next printable surface location indicated by a line.

15. A method of printing labels or signs at a variety of different physical locations, comprising:

(A) providing a portable printer responsive to a terminal which provides to the printer control commands and data representative of information to be printed, the portable printer comprising:

a spindle for receiving, holding, and dispensing a roll of stock, the spindle having at least one adjustable edge guide to align stock dispensed therefrom in a predetermined alignment with at least one downstream component, a direct thermal print mechanism comprising a printhead, a stock feed platen, and an adjustable spring mechanism, the printhead being resiliently biased toward the stock feed platen by the adjustable spring mechanism which is operatively disposed to permit adjustment of pressure of the printhead on the platen, the direct thermal print mechanism being capable of receiving and printing on stock dispensed from the spindle, a cutting mechanism disposed downstream of the direct thermal print mechanism for cutting stock exiting the direct thermal print mechanism, a programmable electronic controller responsive to the commands and data provided by the terminal for operating the direct thermal print mechanism, the electronic controller including a microprocessor and memory and being capable of detecting and conveying to the terminal an operating state of the printer, and a rechargeable and removable battery pack for providing power to the direct thermal print mechanism and the electronic controller thereby allowing the printer to be transported and operated without a connection to a fixed-position external power source;

(B) providing the terminal and transporting the printer and the terminal to one of a plurality of physical locations at which signs or labels are to be printed and then displayed;

(C) operating the terminal at that location to provide to the printer the control commands and data representative of information to be printed such that the printer produces the desired signs or labels for that location; and (D) transporting the printer and the terminal to another location and then repeating step (C) until all locations at which signs or labels are to be printed and then displayed have been visited.

* * * * *